US005722260A

United States Patent [19]

Mangano

[11] Patent Number: 5,722,260

[45] Date of Patent: Mar. 3, 1998

[54] REVERSIBLE JEWELRY CLASP FOR NECKLACES AND/OR BRACELETS AND INTERCHANGEABLE JEWELRY ASSEMBLY EMPLOYING SAME

[76] Inventor: Joy Mangano, Sun Hill Rd., Nesconset, N.Y. 11767

[21] Appl. No.: 762,930

[22] Filed: Dec. 10, 1996

[51] Int. Cl.[6] ..... A44C 5/00

[52] U.S. Cl. ..... 63/3.1; 24/71 J

[58] Field of Search ..... 63/3, 3.1, 4, 19; 24/71 J, 116 R, 116 A, 616, 303

[56] References Cited

U.S. PATENT DOCUMENTS

| | | | |
|---|---|---|---|
| 229,257 | 6/1880 | King . | |
| 1,494,680 | 5/1924 | Fisk . | |
| 1,578,940 | 3/1926 | Wacha . | |
| 1,813,963 | 7/1931 | Schick . | |
| 2,051,591 | 8/1936 | Brogan . | |
| 2,440,012 | 4/1948 | Haver | 24/116 A X |
| 2,586,758 | 2/1952 | Zerr . | |
| 2,615,227 | 10/1952 | Hornik . | |
| 2,623,256 | 12/1952 | Feibelman | 63/3 X |
| 2,635,315 | 4/1953 | Kaufman | 63/4 X |
| 2,644,992 | 7/1953 | McFarland . | |
| 2,654,929 | 10/1953 | Feibelman | 24/303 |
| 3,208,238 | 9/1965 | Spitzer . | |
| 4,530,221 | 7/1985 | Weinberg . | |
| 4,611,368 | 9/1986 | Battersby . | |
| 5,050,276 | 9/1991 | Pemberton | 24/303 |
| 5,214,940 | 6/1993 | Capilfali . | |
| 5,341,659 | 8/1994 | Wright . | |
| 5,367,891 | 11/1994 | Furuyama | 63/3 X |
| 5,572,887 | 11/1996 | Geswelli | 63/3 |

*Primary Examiner*—David M. Purol
*Attorney, Agent, or Firm*—Galgano & Burke

[57] ABSTRACT

Jewelry having a jewelry clasp comprising a pair of clam-shell-like clasp halves pivotally joined together and movable between an open and a closed position. A pair of hooks are mounted on the inner side of one of the clasp half for interchangeably and releasably attaching to the ends of a string of pearls or chain necklaces. A pair of magnets are attached to the inner side of the clasp halves to maintain the clasp halves in a normally closed position.

19 Claims, 4 Drawing Sheets

REVERSIBLE JEWELRY CLASP FOR NECKLACES AND/OR BRACELETS AND INTERCHANGEABLE JEWELRY ASSEMBLY EMPLOYING SAME

BACKGROUND OF THE INVENTION

The present invention relates generally to jewelry. More particularly, the present invention relates to a novel, ornamental reversible jewelry clasp for necklaces, bracelets, and the like, as well as an interchangeable jewelry assembly employing the same.

Necklaces and bracelets are widely popular jewelry items and typically include a clasp for holding the ends thereof together so that they may be worn around a wearer's neck or wrist, respectively. The clasp generally includes a small solid metal ring attached to one end of the necklace or bracelet, and a releasable two-part spring biased ring attached to the other end of the necklace or bracelet. One drawback with such clasps is that it is often difficult for a wearer to connect and disconnect the ends of the necklace or bracelet. Another drawback of such clasps is that they are unattractive and distract from the overall ornamental design of the necklace or bracelet.

Various attempts have been made to provide releasable ornamental clasps for attaching the ends of either a necklace or bracelet. For example, U.S. Pat. No. 229,257 to King discloses a necklace-fastening which includes two leaves hingedly connected together at one end with the hingedly connected end comprising a spring mechanism for holding the leaves in a closed position. A pair of spaced-apart hooks are mounted on one of the leaves and extend through openings in the other leaf to attach to the ends of a necklace. U.S. Pat. No. 4,611,368 to Battersby discloses a decorative and protective jewelry chain guard which includes a hinged box with openings to pass the ends of the chain therethrough. The ends of the chain are placed on a single post located inside the box. Both clasps disclosed in King and Battersby have the drawback should the clasp open, the ends of the necklace can readily detach from the clasp.

U.S. Pat. No. 2,615,227 to Hornik discloses a magnetic clasp having two separate interfitting magnetic structures which magnetically and mechanically connect to one another. The outside of each structure attaches to one end of the jewelry. Other jewelry clasps include U.S. Pat. No. 1,494,680 to Fisk; U.S. Pat. No. 1,578,940 to Wacha; U.S. Pat. No. 1,813,963 to Schick; U.S. Pat. No. 2,051,591 to Brogan; U. S. Pat. No. 2,586,758 to Zerr; U. S. Pat. No. 2,644,992 to McFarland: U.S. Pat. No. 3,208,238 to Spitzer; U. S. Pat. No. 4,530,221 to Weinberg U.S. Pat. No. 5,341,659 to Wright; and a dress clasp for locks on jewelry is disclosed in U.S. Pat. No. 5,214,940 to Capifali. By and large, the clasps disclosed are complicated in design, difficult, cumbersome to employ and/or unaesthetic.

There is, therefore, a need for an ornamental reversible jewelry clasp and jewelry assembly employing the same which is interchangeable with and readily attachable to the ends of a variety of necklaces or bracelets in a manner which, on the one hand, provides a secure yet concealed or hidden from view attachment of the ends of the necklace or bracelet and, on the other hand, provides an attractive appearance and affords a wide range of jewelry necklace/bracelet and clasp combinations to provide the wearer with a multitude of jewelry fashion "options".

SUMMARY OF THE INVENTION

Accordingly, it is an object of the present invention to provide novel jewelry having a jewelry clasp which when in use, securely and releasably connects together and conceals the ends of a necklace, bracelet, and the like, and, at the same time, affords a single integral attractive overall appearance to the jewelry.

It is another object of the present invention to provide such jewelry in which the jewelry clasp has the same or different designs on both sides thereof so that the clasp is reversible.

It is also an object of the present invention to provide such jewelry in which the jewelry clasp is interchangeable with both a string of pearls and chain necklaces, bracelets, and the like, to quickly form different overall pieces of jewelry.

It is still another object of the present invention to provide such jewelry in which the jewelry clasp conceals the locking mechanism used for attaching the ends of necklaces, bracelets, and the like, so as to not distract from the overall appearance of the jewelry.

It is still yet another object of the present invention to provide such jewelry in which the jewelry clasp when clasped provides a secure and dependable mechanical and magnetic interlock to prevent accidental separation of the ends of a necklace, bracelet, and the like, and which allows quick and facile opening and closing thereof.

It is a further object of the present invention to provide such jewelry in which the jewelry clasp is of relatively simple design, may be readily decoratively embellished, and which may be simply and inexpensively fabricated.

Certain of the foregoing and related objects are readily obtained in accordance with the present invention by the provision of a jewelry clasp for releasably clasping the ends of jewelry together, in which the jewelry clasp comprises a pair of generally clam-shell-like clasp halves each of which having a first end portion and a second end portion. The first end portion are hingedly joined together to allow for movement of the clasp halves between an open position in which the second end portions of the clasp halves are spaced apart from one another and a normally closed position in which the second end portions are pivotally moved to a close abutting relationship relative to one another. A pair of hooks are mounted on a inner side of at least one of the clasp halves on each of which a respective end of the jewelry may be releasably mounted.

A pair of magnets, each of which is mounted on an opposite one of the second end portions, are disposed in an opposing aligned position for registry and magnetic contact with one another to thereby releasably maintain the clasp halves in the normally closed position with the jewelry ends firmly clasped within the clasp halves. Preferably, one or both clasp halves have a decorative outer surface.

Certain of the foregoing and related objects are also readily obtained in accordance with the present invention by the provision of a jewelry clasp for attaching together the ends of jewelry, in which the clasp comprises a pair of clasp halves, each having a first end portion hingedly joined together so that the clasp halves are movable between an open position and a closed position. Connecting means contained between the pair of clasp halves when the clasp halves are moved to a closed position connect to a first end portion and a second end portion of jewelry.

Magnetically releasably connecting means connect a second portion of each of the pair of clasp halves to operably maintain the pair of clasp halves in a normally closed position. Preferably, the magnetic means comprises at least one magnet, and desirably a pair of magnets.

Certain of the foregoing and related objects are further readily obtained in accordance with the present invention by the provision of a jewelry clasp for attaching together the ends of jewelry, in which the clasp comprises a first clasp half and a second clasp half, each having a first end portion hingedly joined together so that the clasp halves are movable between an open position and a closed position. Hook means attached to the first clasp half attach to a first end portion and a second end portion of jewelry. The hook means comprises a C-shaped member defining a pair of inwardly facing hooks wherein end portions of the hooks are disposed adjacent each other so as to allow connecting to one end portion of the jewelry at a time.

Releasable connecting means connects a second portion of each of the clasp halves, and is operable to maintain the pair of clasps halves in a normally closed position. Preferably, the releasable connecting means comprise at least one magnet and desirably a pair of magnets. Also preferably, the second clasp half comprises recesses aligned with and conforming to the uppermost portions of the inwardly facing hooks, and the first clasp half and the second clasp hale have opposing aligned recesses which define a chamber when the clasp halves are disposed in a closed position. Furthermore, at least one or preferably both of the clasp halves comprises elongated notches which define apertures extending into the chambers and through which respective end portions of the jewelry can pass.

Certain of the foregoing and related objects are still further readily obtained in accordance with the present invention by the provision of jewelry comprising an elongated jewelry strand having a pair of ends, and at least one clasp. The clasp comprises a pair of clasp halves, each having a first end portion and a second end portion. The first end portions are hingedly joined together to allow for movement of the clasp halves between an open position in which the second end portions of the clasp halves are spaced apart from one another, and a normally closed position in which the second end portions are pivotally moved to a close abutting relationship relative to one another.

Releasable mounting means mounted on a inner side of at least one of the clasp halves maintains the ends of the elongated jewelry strand inside the clasp. Releasable connecting means is provided for connecting together the second portions of each of the clasp halves and is operable to maintain the pair of clasps halves in a normally closed position. Preferably, the end portions of the strand comprises a ring and a bead. Desirably, the strand is a string of pearls and/or a chain.

BRIEF DESCRIPTION OF THE DRAWINGS

Other objects and features of the present invention will become apparent from the detailed description considered in connection with the accompanying drawings, which disclose several embodiments of the present invention.

It is to be understood that the drawings are to be used for the purposes of illustration only and not as a definition of the limits of the invention.

In the drawings, wherein similar reference characters denote similar elements throughout the several views:

FIG. 1A is a top view of one embodiment according to the present invention for jewelry having a jewelry clasp attached to the ends of a string of pearls;

FIG. 1B is a bottom view of the jewelry shown in FIG. 1A;

FIG. 2A is a top view of the jewelry shown in FIG. 1A in which the jewelry clasp is disposed in an open position;

FIG. 2B is a front side elevational view of the jewelry shown in FIG. 1A in which the jewelry clasp is disposed in an open position;

FIG. 2C is a cross-sectional view of the jewelry taken along line 2C—2C shown in FIG. 1A;

FIG. 3A is a left side elevational view of the jewelry shown in FIG. 1A in which the jewelry clasp is disposed in an open position;

FIG. 3B is a left side elevational end view of the jewelry shown in FIG. 1A in which the jewelry clasp is disposed in a closed position;

FIG. 3C is a left side elevational end view of an alternative embodiment of the jewelry clasp in which the jewelry clasp is disposed in a closed position;

FIG. 4A is a top view of an alternative embodiment of the present invention for jewelry having a jewelry clasp attached to the ends of a flat chain bracelet;

FIG. 4B is a bottom view of the jewelry shown in FIG. 4A; and

FIG. 4C is a top view of the jewelry shown in FIG. 4A in which the jewelry clasp is disposed in an open position.

DETAILED DESCRIPTION OF THE PREFERRED EMBODIMENTS

Figure 1A:
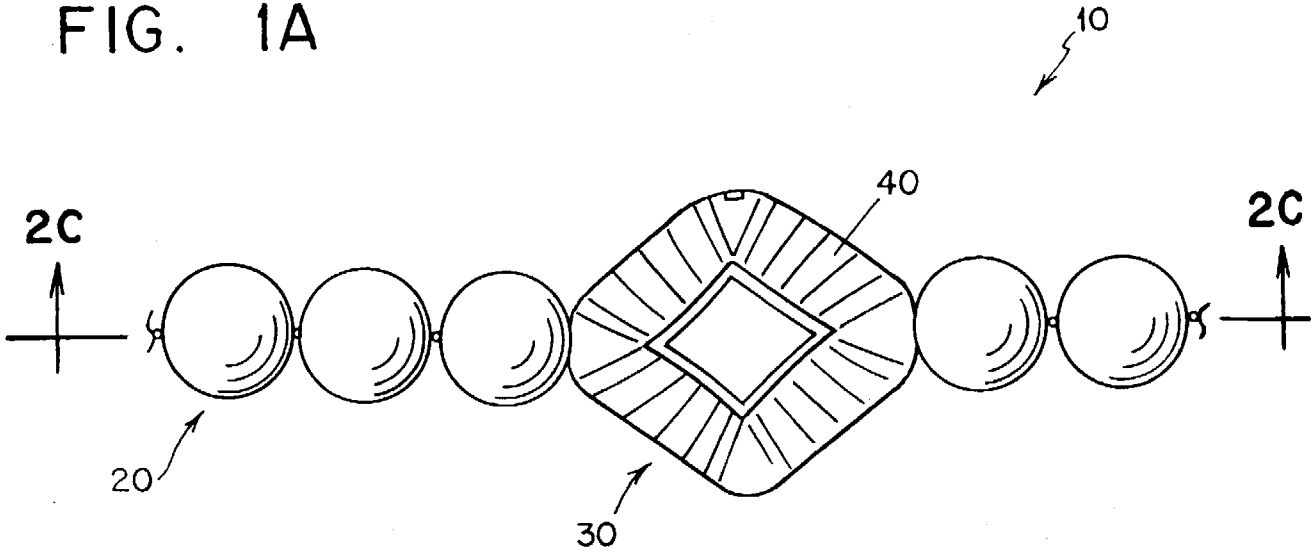
Figure 1B:
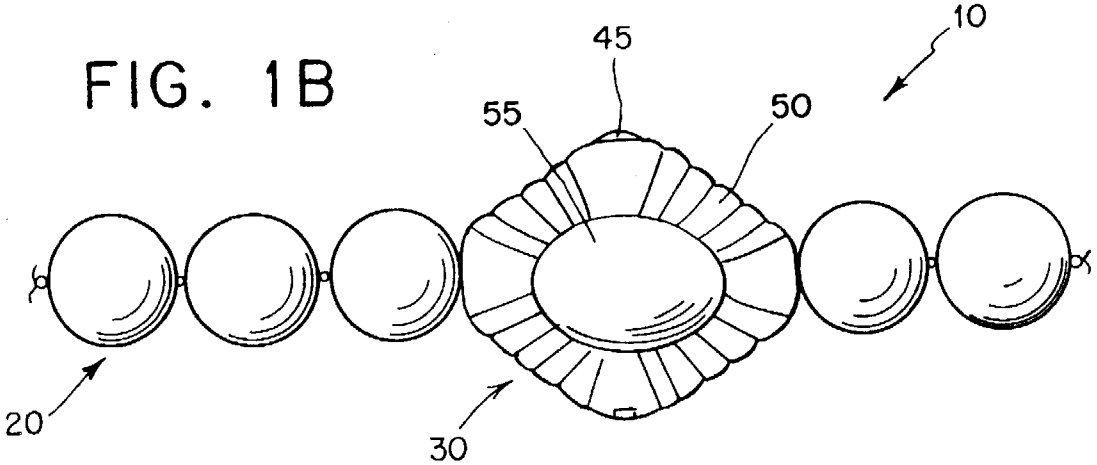

Turning now in detail to the drawings and in particular to FIGS. 1A and 1B, therein illustrated is an item of jewelry such a necklace 10 according to one embodiment the present invention. In this illustrated embodiment, necklace 10 comprises a string of pearls 20 (the end portions thereof being shown) generally formed into a single loop with the ends thereof releasably attached to a diamond-shaped jewelry clasp 30 so that necklace 10 provides an overall attractive ornamental appearance without the typical distraction of a visible locking mechanism or visible portions of a locking mechanism.

Top clasp half 40 desirably has an outer surface decoratively adorned with e.g., an engraved pattern as shown in FIG. 1A, and a bottom clasp half 50 desirably having, e.g., an outer surface decoratively adorned with a centrally located pearl 55 as shown in FIG. 1B, so that clasp 30 is reversible. In essence, clasp 30 has no front or back so that if it flips while being worn the stylized look remains.

Figure 2A:
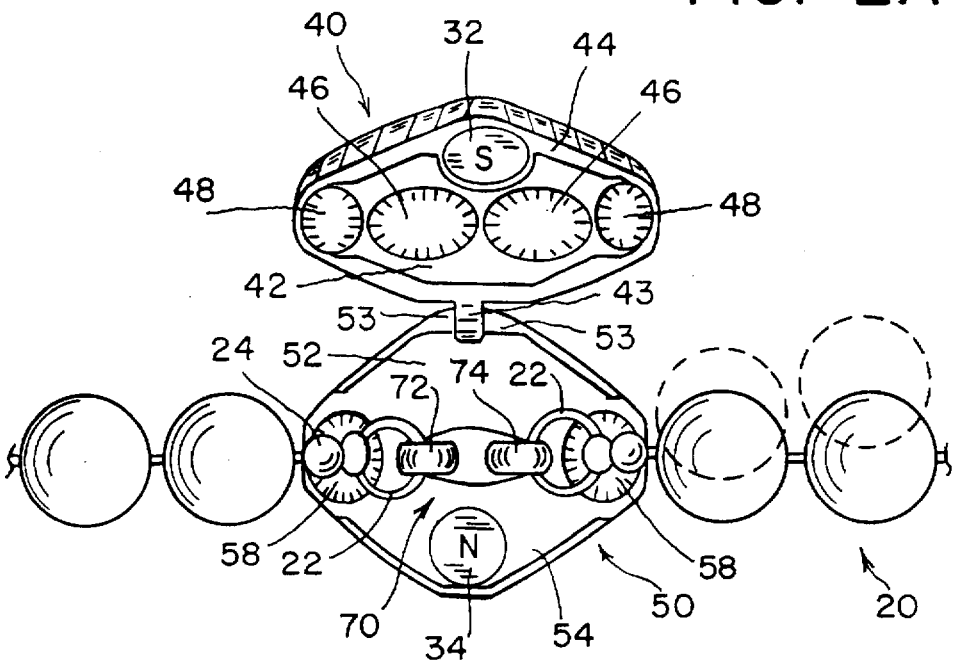
Figure 3A:
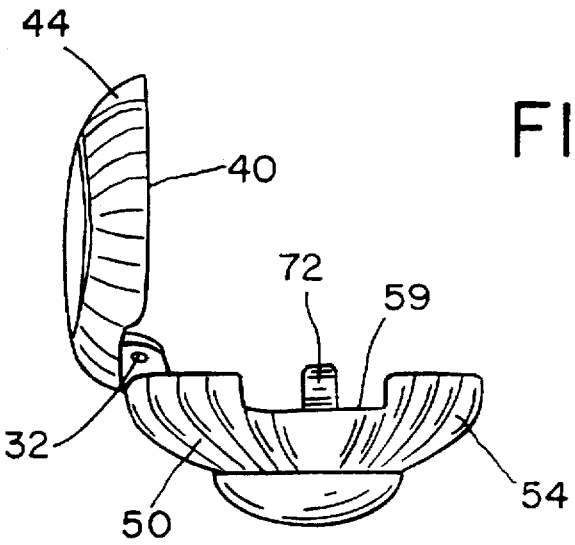
Figure 3B:
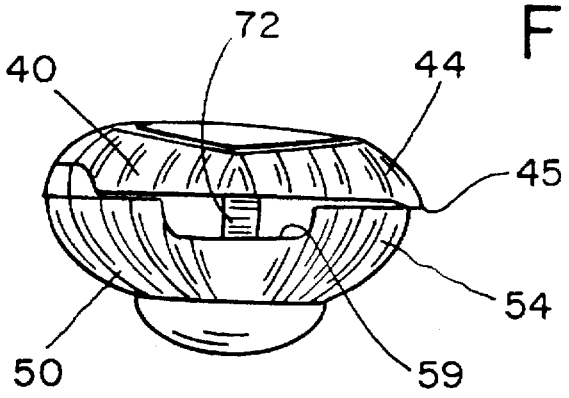

As seen in FIG. 2A, clasp halves 40 and 50 are generally clam-shell-like with each having a first end portion 42 and 52, respectively, hingedly joined together to allow for movement clasp halves 40 and 50 between an open position and a closed position, as best seen in FIGS. 3A and 3B. More particularly, second end portions 44 and 54 of respective clasp halves 40 and 50 are spaced-apart from one another in an open position (FIG. 3A), and are pivotally moved to a close abutting relationship relative to one another in a normally closed position (FIG. 3B).

In this illustrated embodiment as seen best in FIG. 2A, first end portion 52 of bottom clasp half 50 includes two upwardly extending spaced-apart pivot posts or members 53 between which is pivotally mounted via pin 32 (FIG. 3A) a pivot post or member 43 which downwardly depends from first end portion 42 of top clasp half 40. Desirably, when clasp 30 in disposed is a closed position as shown in FIG. 3B, the edge of second end portion 44 of top clasp half 40 is configured to extend beyond the edge of second end portion 54 of bottom clasp half 50 to define a lip 45 against which the wearer's thumb or finger nail can be conveniently positioned to open clasp 30.

With reference to FIG. 2A, to releasably maintain clasp halves 40 and 50 in a normally closed position a magnet 32 is mounted on an inner surface of second end portion 44 of top clasp half 40 and a magnet 34 is mounted on an inner surface of second end portion 54 of bottom clasp half 50 so that they are in an opposing aligned position for registry, and physical and magnetic contact with one another when clasp 30 is closed. Desirably, the magnets comprise a pair of permanent magnets with their polarities disposed so that when the clasp 30 is closed the two magnets attract each other. For example, magnet 32 is attached to top clasp half 40 so that a south pole labeled "S" in FIG. 2A is exposed while magnet 34 is attached to bottom clasp half 50 so that a north pole labeled "N" in FIG. 2A is exposed for magnetic contact with the south pole of magnet 32. Preferably, each of the magnets are recessed in respective halves of clasp 30 and are suitably attached thereto with a glue, epoxy, or the like.

Figure 2B:
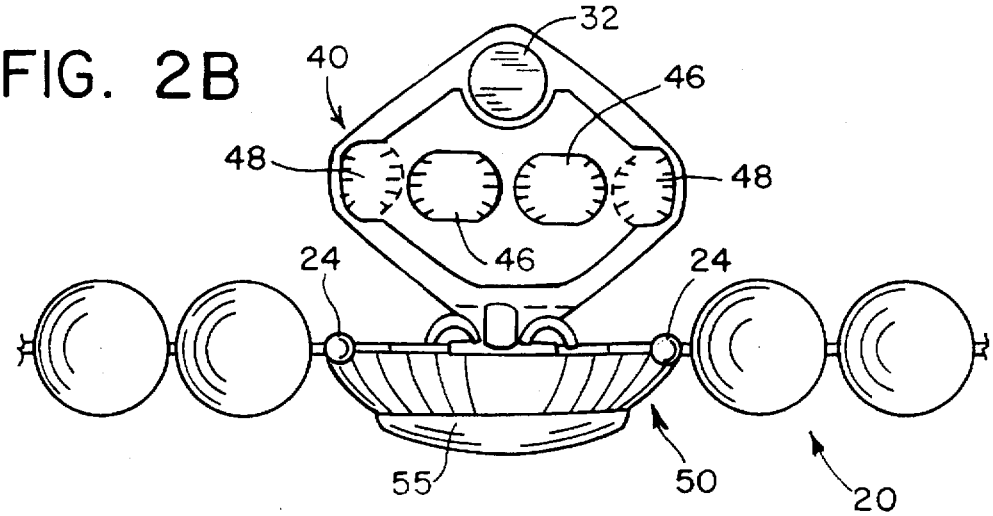
Figure 2C:
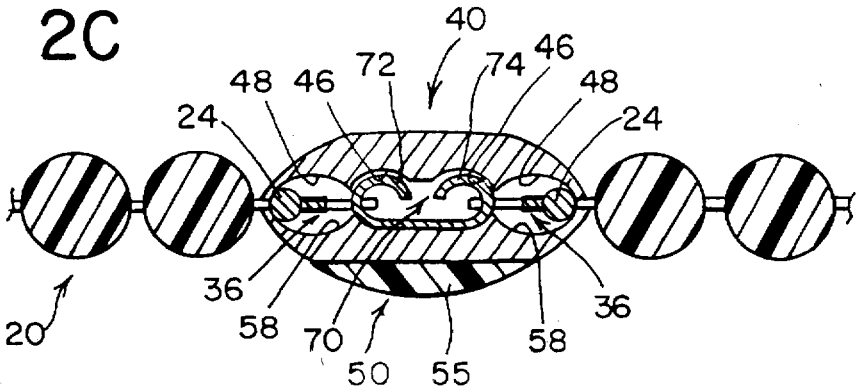

With reference to FIGS. 2A–2C, a generally C-shaped member 70 mounted on an inner side of bottom clasp halve 50, defines a pair of inwardly facing hooks 72 and 74 on each of which a respective end of string of pearls 20 may be releasably mounted. In particular, each of the end portions of string of pearls 20 has a loop, eyelet or ring 22 (best seen in FIG. 2A) which are placed over respective hooks 72 and 74 mounted inside the clasp. Desirably, the hooks are disposed closely adjacent to each other so that only one ring 22 on the string of pearls 20 is releasably attachable at a time to the hooks so that if clasp 30 accidentally becomes opened clasp 30 would likely remain attached to the rings at the end portions of the string of pearls 20. If one end portion of the string of pearls becomes detached from its respective hook, such a hook design will likely maintain the other end portion attached to the clasp.

In this illustrated embodiment, top clasp half 40 conforms to the uppermost convex portions of hooks 72 and 74. In particular, the inner side of top clasp half 40 is provided with two concave recesses 46 each of which is aligned for accommodating, and to conform with, the uppermost convex portions of hooks 72 and 74 when clasp 30 is closed as shown in FIG. 2C. The coaction of the concave recesses with the convex portion of the hooks securely maintain the rings mounted on the hook and reduce the likelihood of the rings becoming detached from the hooks.

Also in this illustrated embodiment, clasp halves 40 and 50 comprise a plurality of recesses which provide chambers for containing beads 24 attached to the ends of the string of pearls 20 disposed just before rings 22. In particular, top clasp half 40 is provided with two recesses 48 each of which is aligned for registry with two recesses 58 in bottom clasp half 50 so that when clasp 30 is closed as shown in FIG. 2C chambers 36 are formed.

Figure 3C:
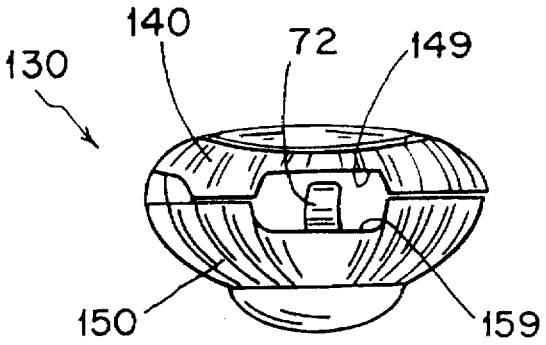

With reference to FIGS. 3A and 3B, bottom clasp half 50 has opposite elongated notched portions 59 (one end being shown in FIGS. 3A and 3B) which, when jewelry clasp 30 is closed, define an elongated aperture through which the end portions of string of pearls or chain necklace can extend. The elongated aperture allows string of pearls 20 to angle slightly with respect to clasp 30 (as shown in dashed lines in FIG. 2A) so that clasp 30 is less likely to flip when positioned around the neck of a wearer. FIG. 3C illustrates an alternative embodiment of a clasp 130 in which both the top clasp half 140 and the bottom clasp half 150 are provided with opposite elongated notched portions 149 and 159, respectively. Desirably, the elongated apertures are large enough to allow the string portion of the string of pearls 20 to pass therethrough, but small enough so that bead 24 will not pass therethrough. Therefore, in the illustrated embodiment, clasp 30 provides a dual means for attaching to the ends of the string of pearls 20.

Figure 4A:
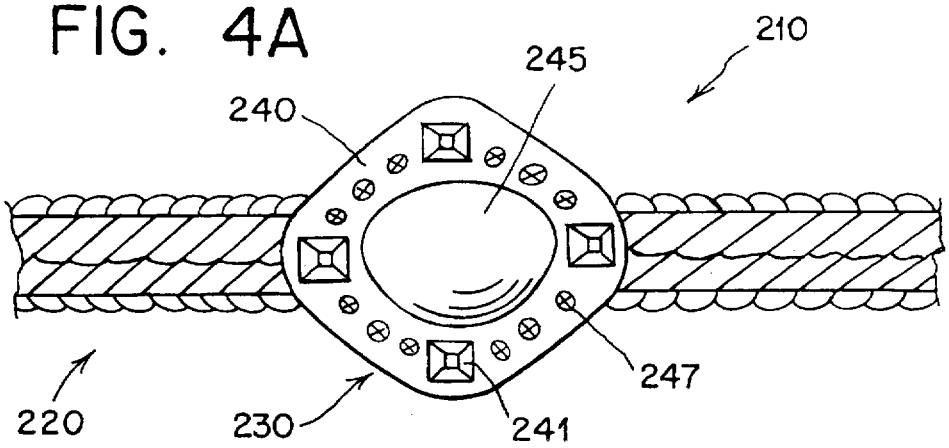
Figure 4B:
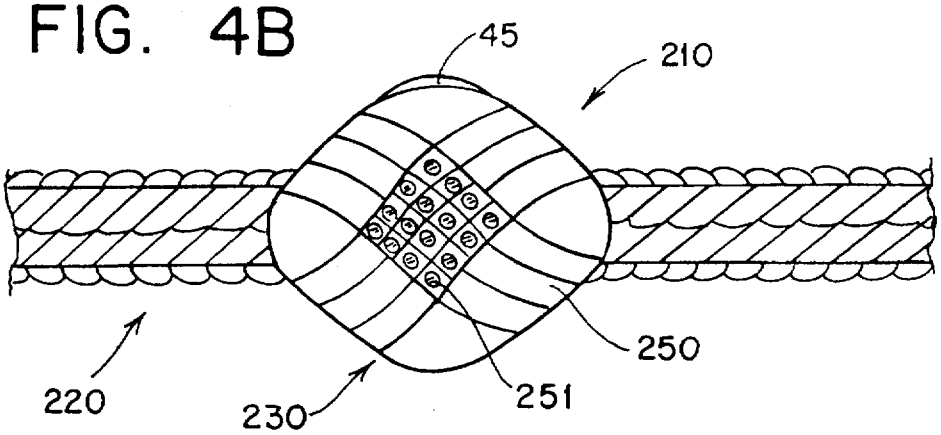
Figure 4C:
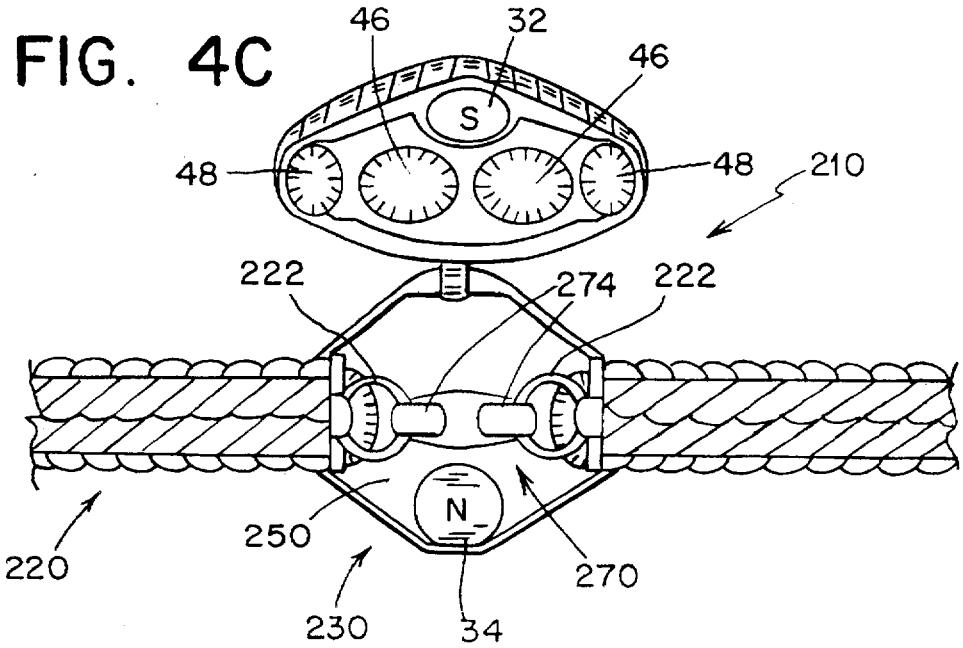

FIGS. 4A–4C illustrate another embodiment of an item of jewelry such as flat-chain, gold necklace 210 according to the present invention and includes a clasp 230 attached to the ends of a chain 220. Clasp 230 is essentially the same as clasp 30 except that clasp 230 is adorned with square diamonds 241, round diamonds 247 and an oval pearl 245 on top clasp half 240. Bottom clasp half 250 is adorned with a diamond-shaped pattern formed from a plurality of round diamonds 251.

Bottom clasp half 250 and clasp 230 is provided with a C-shaped member 270 which define a pair of hooks 272 and 274 for attaching to the ends of chain 220, the ends of which are provided with eyelets or rings 222. Advantageously, clasps 30 and 230 are interchangeable with the string of pearls 20 and chain 220 to readily provide different overall pieces or looks of jewelry.

In operation, with reference to FIG. 3B, a wearer initially opens jewelry clasp 30, i.e., spreads top clasp half 40 away from bottom clasp half 50. The wearer then places one ring 22 of strand of pearls 22 within one hook 72 and 74 and the other ring 22 within the other hook as shown in FIG, 2A. The wearer then pivotally closes top clasp half 40 against bottom clasp half 50 to engage magnets 32 and 34 in the usual fashion. When this operation is complete, the clasp halves 40 and 50 of clasp 30 are disposed in a closed position by a magnetic lock and a complete piece of jewelry is formed with little opportunity for the ends of the string of pearls 20 to be accidentally detached from the clasp. At the same time, the functional interconnecting of the ends of the jewelry are completely hidden from view.

If it is desired to release the clasp from the ends of the string of pearls 20, the top clasp half 40 is lifted and the rings 22 of the string of pearls are removed. Advantageously, clasp 30 can be interchanged with clasp 230, and string of pearls 20 can be interchanged with chain 220 in the manner described above.

while it is preferable that the ends of the necklace or bracelet be provided with solid rings from the present description it will be appreciated to those skilled in the art that the jewelry clasp of the present invention may also be used with bracelets and necklaces having conventional clasp ends comprising a solid ring and a two-piece releasable spring biased ring.

From the present description it will also be appreciated to those skilled in the art that the top and bottom clasps halves can include any reasonable number of pivot members to accommodate the opening and closing of the clasp. It is also appreciated that instead of a pin for attaching the pivot member, the pivot members can include lateral extending detents which are received in recesses in adjacent pivot members. It will further be appreciated to those skilled in the art that the magnetic closure means of the present invention may comprise one permanent magnet and a cooperating magnetically attractive material such as steel for magnetically maintaining the clasp in a closed position.

In addition, from the present description it will be appreciated to those skilled in the art that the jewelry clasp can be configured to have a wide variety of shapes, sizes, finishes, and designs for interchangeably and reversibly attaching to the ends of various necklaces, bracelets or the like. For example, the clasp can be square-shaped, round-shaped, oval-shaped, or rectangular-shaped. Preferably, the clasp when used with a chain has a surface finish to match the metal finish of the chain which may be gold alloy, gold filled, gold plated, gold tone, or other similar precious, semi-precious or non-precious metal.

Thus, while several embodiments of the present invention have been shown and described, it is appreciated from the present description that many changes and modifications may be made thereunto without departing from the spirit and scope of the invention.

What is claimed is:

1. A jewelry clasp for releasably clasping the ends of jewelry together, comprising:

a pair of generally clam-shell-like clasp halves, each having a first end portion and a second end portion, said first end portions being hingedly joined together to allow for movement of said clasp halves between an open position in which said second end portions of said clasp halves are spaced apart from one another and a normally closed position in which said second end portions are pivotally moved to a close abutting relationship relative to one another;

a pair of hooks mounted on a inner side of at least one of said clasp halves on each of which a respective end of the jewelry may be releasably mounted; and a pair of magnets, each of which is mounted on an opposite one of said second end portions in an opposing aligned position for registry and magnetic contact with one another to thereby releasably maintain said clasp halves in said normally closed position with said jewelry ends firmly clasped within said clasp halves.

2. The jewelry clasp according to claim 1, wherein at least one of said clasp halves has a decorative outer surface.

3. The jewelry clasp according to claim 2, wherein both of said clasp halves have a decorative outer surface so that said clasp is reversible.

4. A jewelry clasp for attaching together the end of jewelry, said clasp comprising:

a pair of clasp halves, each having a first end portion hingedly joined together so that said clasp halves are movable between an open position and a closed position;

means for connecting to a first end portion and a second end portion of jewelry, said means contained between said pair of clasp halves, when said clasp halves are moved to a closed position; and means for magnetically releasably connecting a second portion of each of said pair of clasp halves, said magnetic means operable to maintain said pair of clasp halves in a normally closed position.

5. The jewelry clasp according to claim 4, wherein said magnetic means comprises at least one magnet.

6. The jewelry clasp according to claim 5, wherein said magnetic releasable means comprises a pair of magnets.

7. A jewelry clasp for attaching together the ends of jewelry, said clasp comprising:

a first clasp half and a second clasp half, each having a first end portion hingedly joined together so that said clasp halves are movable between an open position and a closed position;

hook means for attaching to a first end portion and a second end portion of jewelry, said means attached said first clasp half and comprising a C-shaped member defining a pair of inwardly facings hooks wherein end portions of said hooks are disposed adjacent each other so as to allow connecting of one end portion of the jewelry at a time; and means for releasably connecting a second portion of each of said clasp halves, said means operable to maintain said pair of clasps halves in normally closed position.

8. The jewelry clasp according to claim 7, wherein said releasable connecting means comprise at least one magnet.

9. The jewelry clasp according to claim 8, wherein said releasable connecting means comprise a pair of magnets.

10. The jewelry clasp according to claim 7, wherein said second clasp half comprises recesses aligned with and conforming to uppermost portions of said inwardly facing hooks.

11. The jewelry clasp according to claim 7, wherein said first clasp half and said second clasp half have opposing aligned recesses which define a chamber when said clasp halves are disposed in a closed position.

12. The jewelry clasp according to claim 11, wherein at least one of said clasp halves comprises elongated notches which define apertures extending into said chambers and through which respective end portions of jewelry can pass.

13. The jewelry clasp according to claim 11, wherein said clasps halves have opposing aligned elongated notches which define apertures extending into said chambers and through which respective end portions of jewelry can pass.

14. Jewelry comprising:

an elongated jewelry strand having a pair of ends;

at least one clasp, said clasp comprising a pair of clasp halves, each having a first end portion and a second end portion, said first end portions being hingedly joined together to allow for movement of said clasp halves between an open position in which said second end portions of said clasp halves are spaced apart from one another and a normally closed position in which said second end portions are pivotally moved to a close abutting relationship relative to one another;

means for releasably mounting said ends of said elongated jewelry strand inside said clasp, said means being mounted on a inner side of at least one of said clasp halves; and means for releasably connecting together said second portions of said clasp halves, said means operable to maintain said pair of clasps halves in a normally closed position.

15. The jewelry according to claim 14, wherein each end portions of said strand comprises a ring.

16. The jewelry according to claim 14, wherein each of said end portions of said strand comprises a bead.

17. The jewelry according to claim 14, wherein said strand is a string of pearls.

18. The jewelry according to claim 14, wherein said strand is a chain.

19. The jewelry according to claim 14, comprises a string of pearls and a chain.

* * * * *